US005526086A

United States Patent [19]

Rizzo

[11] Patent Number: 5,526,086

[45] Date of Patent: Jun. 11, 1996

[54] FILM CARRIER TRANSPORT ADAPTOR

[75] Inventor: Michael Rizzo, Hillside, Ill.

[73] Assignee: Bisco International, Inc., Hillside, Ill.

[21] Appl. No.: 353,458

[22] Filed: Dec. 9, 1994

[51] Int. Cl.[6] ..... G03D 17/00

[52] U.S. Cl. ..... 354/312; 354/337

[58] Field of Search ..... 354/339, 322, 354/337, 312; 359/467; 353/120

[56] References Cited

U.S. PATENT DOCUMENTS

| | | | |
|---|---|---|---|
| D. 287,858 | 1/1987 | Gautestad | D16/26 |
| 4,116,533 | 9/1978 | Nerlich | 350/135 |
| 4,368,969 | 1/1983 | Bashung | 354/339 |
| 4,884,885 | 12/1989 | Schweinsberg | 353/120 |
| 5,019,857 | 5/1991 | Milovanovich | 354/322 X |
| 5,250,342 | 10/1993 | Lang et al. | 428/138 |
| 5,311,356 | 5/1994 | Frelich | 359/467 |
| 5,330,053 | 7/1994 | Tabuchi et al. | 206/455 |

*Primary Examiner*—D. Rutledge

*Attorney, Agent, or Firm*—Lee, Mann, Smith, McWilliams, Sweeney & Ohlson

[57] ABSTRACT

The present invention relates to a device used to position and secure smaller sized film, during film processing in a film processor adapted for processing larger sized film. The generally rectangular film carrier transport adaptor is of a size adaptable to pass through film processor used to process larger sized film. The adaptor has one or more apertures extending through the base sheet. Pressure sensitive adhesive is located around the perimeter of each aperture to hold the film to the adaptor. A peelably removable liner is located around the apertures and covers the pressure sensitive adhesive to protect the adhesive until the film is ready to be placed over the aperture and against the adhesive for processing. The film carrier transport adaptor can be comprised of a number of different laminate combinations which are made of materials which will not be damaged or destroyed when exposed to chemicals or rollers during film processing.

6 Claims, 2 Drawing Sheets

FILM CARRIER TRANSPORT ADAPTOR

FIELD OF THE INVENTION

The present invention relates to the field of film processors, and more particularly, to the field to adaptors used to secure film and carry the film through a film processor.

BACKGROUND OF THE INVENTION

Presently, there exist films of a variety of sizes. Larger sized film may be used to the x-ray body parts of patients in hospitals. There also exist smaller sized films such as those used to x-ray teeth and gums in dentistry. The larger sized x-ray films are processed by sending the film through film processors adapted to receive larger sized x-ray film. Similarly, the smaller sized x-ray films are sent through film processors adapted to receive smaller sized x-ray film. This requires two separate processors for processing film of different sizes. Separate processors often are placed in the same area in hospitals or clinics.

There are a number of prior art devices used to hold film for viewing after the film has been developed. Their construction usually includes molded plastic with window cutouts. These devices are usually debossed to the size of the film and have several indentations on the inside edge of the window to snap the film into and hold it secure. There exist both single holders having only one window, and multiple holders having two through twelve windows. These holders are designed and used only to hold film after the film has been developed. There exists a need for an adaptor capable of holding films of various sizes during processing in which only one size film processor is needed.

SUMMARY OF THE INVENTION

To solve the problem of having to purchase both a small and a large film processor to process small sized dental x-ray film and also larger x-ray film, the present invention provides a film carrier transport adapter capable of holding and transporting smaller sized dental x-ray film, through the same film processor used to process larger sized x-ray film.

The carrier for the x-ray film according to the present invention comprises a base sheet of paper, cardboard or plastic or some combination thereof, with one or more cut-out apertures (or windows) in the sheet. One surface of the sheet surrounding the aperture carries a layer of pressure sensitive adhesive adapted to secure the film to the base sheet. A peelable liner covers the pressure-sensitive adhesive prior to use.

Film is placed in the carrier by first removing all wrappers from the film, if any, then removing the protective liner from around one or more windows to expose the pressure sensitive adhesive. Once the protective liner has been removed, the film is placed within the perimeter of the window and pressed gently against the adhesive to insure sufficient contact to the adhesive to remain in position. The carrier is then sent through the film processor and the film is processed in the normal manner.

DESCRIPTION OF THE PREFERRED EMBODIMENT

Figure 1:
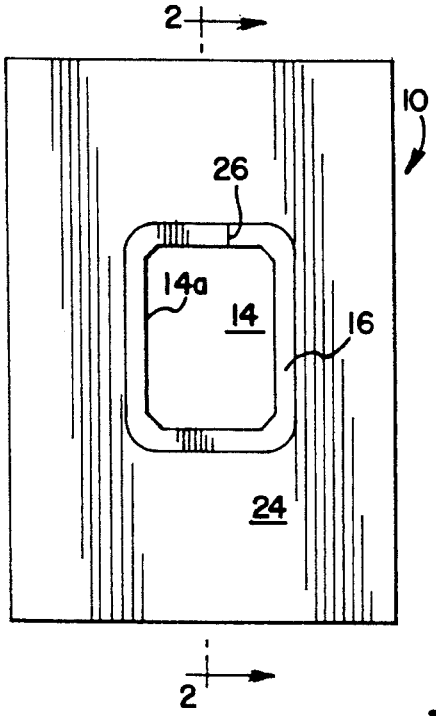
FIG. 1 is a front elevational view of an embodiment of the film carrier transport adaptor having one window or aperture therethrough.
Figure 3:
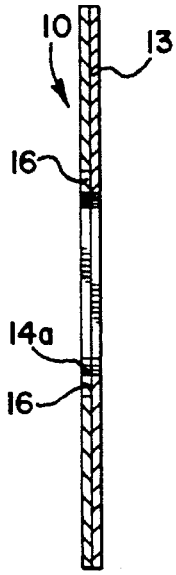
FIG. 3 is a cross-sectional view through lines 2—2 of FIG. 1.

FIG. 1 shows a film carrier transport adaptor 10 for holding film 12 during film processing. The film carrier 10 is comprised of a base sheet 13, preferably made of paper, polyester or plastic or some combination thereof and may be of a single layer or multiple layers. The sheet is made of a flexible material sufficient for passing trough a film processor without being damaged or destroyed by chemicals used in the film processor or by rollers used in the processor to transport the carrier and film 12 through the processor. In the preferred embodiment, the base sheet is made from silver metallized polyester or black opaque polyester being three to five mils thick, laminated to ninety pound silicone treated paper making it water and chemical resistant. In an alternative embodiment, the base sheet is three to five mil clear polyester laminated to ninety pound black opaque silicone treated paper. Preferably, the base sheet 13 is between 0.002 and 0.020 inches in thickness. As sen in FIGS. 1–9, the base sheet 13 has one or more windows or apertures 14 therethrough.

Each base sheet 13 can consist of a number of different laminates including 1) paper, pressure sensitive adhesive, and paper; 2) plastic, pressure sensitive adhesive and paper, and polyester or suitable substrate; 3) silver polyester, pressure sensitive adhesive and paper, polyester or suitable substrate; or black opaque polyester, pressure sensitive adhesive and polyester, paper or suitable substrate. The minimum overall size of the adaptor is three inches by five inches.

Figure 5:
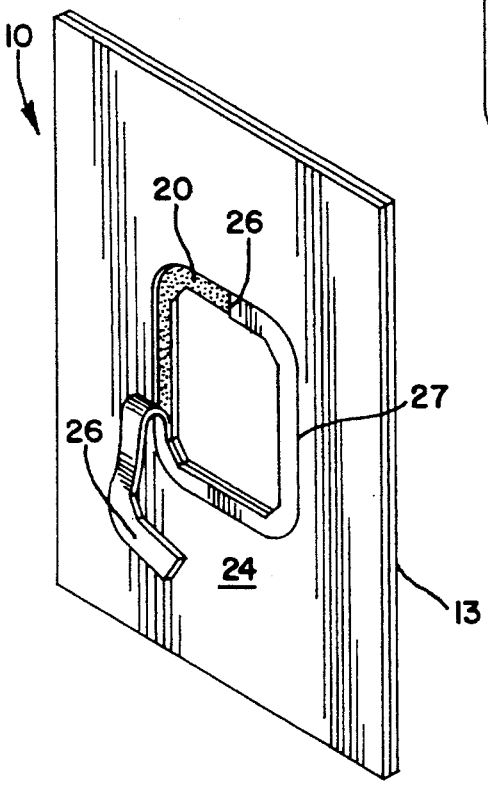
FIG. 5 is a perspective view of an embodiment of the film carrier transport adaptor with the peelable liner partially removed.
Figure 6:
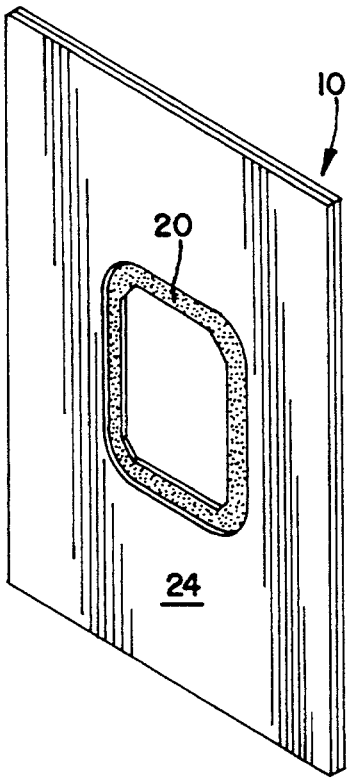
FIG. 6 is a perspective view of an embodiment of the film carrier transport adaptor with the peelable liner completely removed exposing the pressure sensitive adhesive around the window.

FIG. 1 is a front elevational view of an embodiment of the film carrier transport adaptor 10 having one window 14 therethrough with a peelable liner 16 around the perimeter 14*a* of the window 14. The windows 14 are sized to accommodate full viewing of the photographed images on small sized film 12. In the preferred embodiment, the apertures are ⅞ inches×1⅞ inches 1¼ inches×1⅝ inches to accommodate dental film. The windows however can be sized to accommodate any size film to be processed or combinations thereof. Around the perimeter of the window 14 is a layer of pressure sensitive adhesive 20 as best shown in FIGS. 5 and 6. In the preferred embodiment, the adhesive used is a permanent acrylic-based pressure sensitive adhesive.

Figure 7:
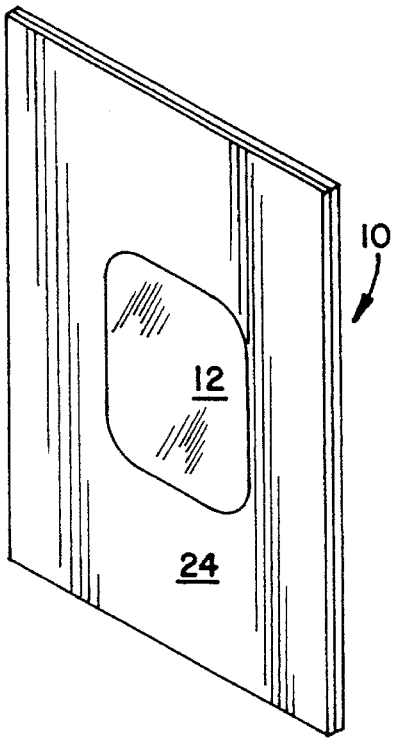
FIG. 7 is a perspective view of an embodiment of the film carrier transport adaptor with a slide of film adhered to the pressure sensitive adhesive around the window.

The drawings herein, and particularly FIGS. 5 and 6, illustrate a narrow band of adhesive 20 completely surrounding the perimeter of the aperture 14. As shown in FIG. 5 a recess is provided in top surface layer 24 of the base sheet 13 surrounding the window 14. The adhesive 20 is disposed within the recess to secure the film 12 to be processed. As shown in FIG. 7, the film 12 is secured within the recess such that the upper surface of the film 12 lies at or below the top surface layer of the base sheet. Although this is the preferred embodiment, other adhesive application arrangements are possible. For example, in the FIG. 6 embodiment adhesive could be applied both above and below the aperture, but not on the sides. Adhesive could be applied on the sides, but not the top or bottom. Adhesive could be applied at spots around the perimeter in a discontinuous application, as, for example, at all four corners. All of these applications, and others which will be apparent to one skilled in the art, are considered to be within the purview of the present invention.

Figure 4:
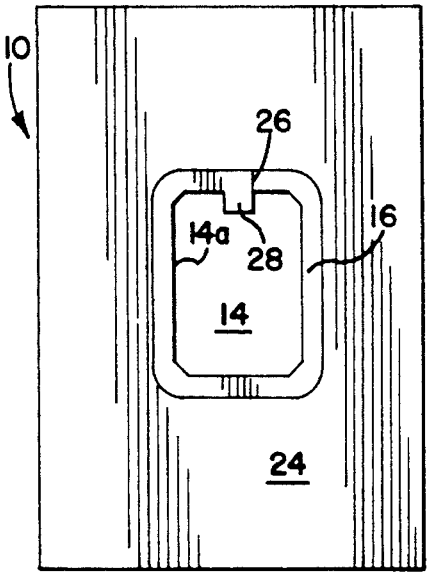
FIG. 4 is a front elevational view of an embodiment of the film carrier transport adaptor having one window therethrough and an extending peel tab.
Figure 2:
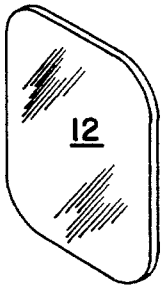
FIG. 2 is a perspective view of a slide of film.

A peelably removable liner 16 covers the pressure sensitive adhesive 20 to protect the adhesive 20 from unintentional contact with surfaces other than the film 12. The liner 16 can be cut from a top surface layer 24 attached to the top side of the base sheet 13. The liner 16 can have a peel cut 26 therein to accommodate a user in peeling the line 16 from the adhesive 20, as seen in FIGS. 1, 4, 5, 8 and 9. As seen in FIG. 4, a peeling tab 28 extends from the peel liner 16 and acts as a supplementary means for providing the user with a means of peeling the liner 16 from the adhesive 20.

Figure 8:
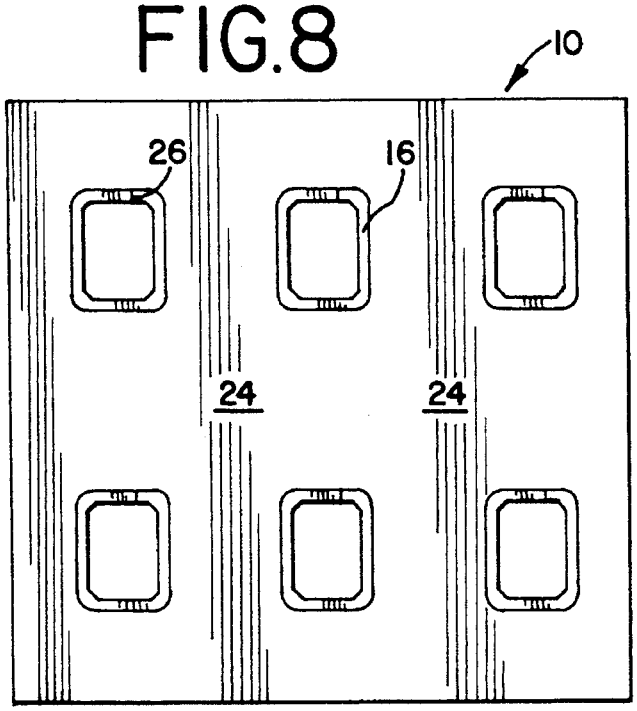
FIG. 8 is a front elevational view of an embodiment of the film carrier transport adaptor having multiple apertures therethrough.

The film carrier can have only one window, as seen in the embodiments of FIGS. 1, and 3–7. Other embodiments may have a plurality of windows for processing multiple slides of film simultaneously as seen in FIGS. 8–9.

Figure 9:
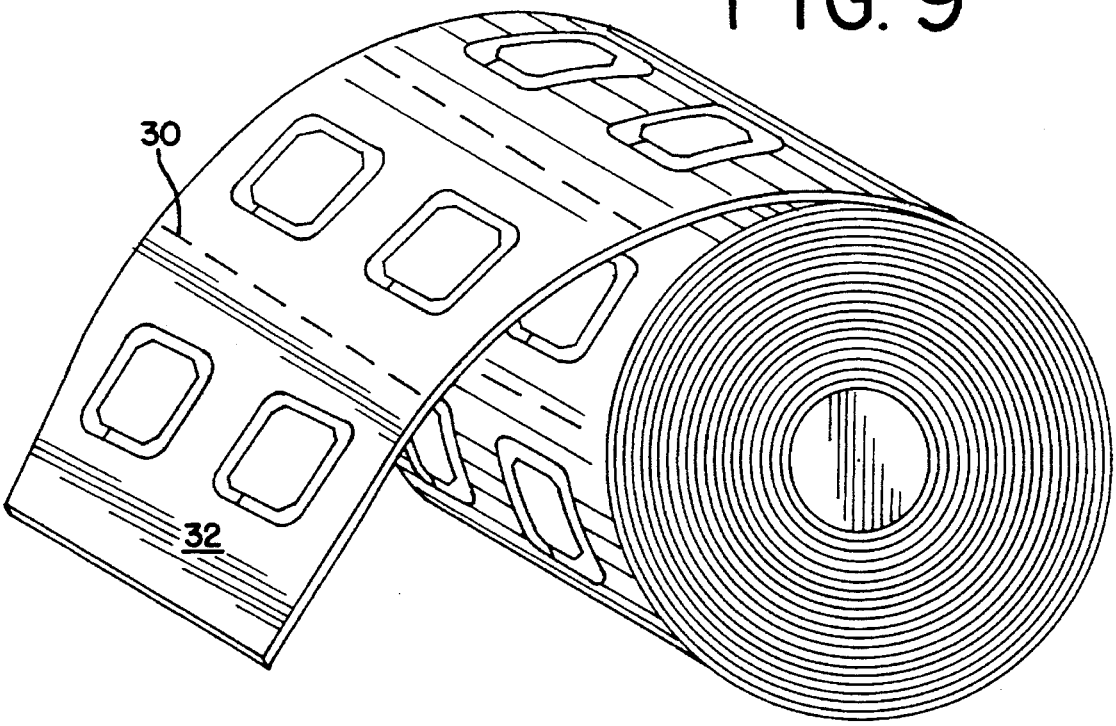
FIG. 9 is a perspective view of an embodiment of the film carrier transport adaptor in roll form and perforated.

The film carrier 10 may be produced in roll form 32 as shown in FIG. 9, having perforations between adjacent units to facilitate easy separation of adjacent units.

An alternative embodiment can be made in which one entire surface of the base sheet 13 is covered with a pressure sensitive adhesive. A peelably removable liner can then be positioned over the entire surface and the adhesive. The aperture is then punched through the entire sheet with what is referred to in the industry as a "kiss-cut". One punch is used to create the aperture. A second punch engages the outer surface only of the peelable liner and creates a slit 27 separating the peelably removable liner 16 from the rest of the top surface layer 24. The operation of this embodiment is the same as the embodiment previously described wherein a separate preformed, precut, peelable liner 16 is applied over a limited application of adhesive.

Various features of the invention have been illustrated and described herein, however, it must be understood that these particular arrangements merely illustrate, and that the invention is to be given its fullest interpretation within the terms of the appended claims.

What is claimed is:

1. A film carrier transport adaptor to secure and position film of a variety of sizes as it passes through a film processor, said adaptor comprising:

a base sheet having a front surface and a back surface;

at least one aperture extending through said base sheet;

a recess provided in said front surface of said base sheet surrounding and being adjacent to said aperture, said recess adapted to receive the film to be processed;

adhesive means disposed within said recess, said adhesive adapted to secure the film to said sheet within said recess during processing; and a peelably removable liner covering said adhesive means and adapted for easy removal when the film is to be adhered to said base sheet.

2. A film carrier transport adaptor as in claim 1 wherein said peelable liner includes an extending tab to assist in removal of said liner.

3. A film carrier transport adaptor as in claim 1 including a plurality of apertures extending through said base sheet adapted to accommodate a plurality of film exposures to be processed in a single pass.

4. A film carrier transport adaptor as in claim 1 in which said base sheet includes a plurality of attached sections with at least one aperture provided in each section, said sections being connected to other adjacent sections by perforations in said base sheet thereby permitting easy detachment of said sections from each other.

5. A film carrier transport adaptor as in claim 1 whereby the film is secured to said base sheet within said recess, such that the upper surface of the film lies at or below said front surface layer of said base sheet.

6. A method of processing film using a film carrier transport adaptor having a base sheet with a front surface and a back surface and at least one aperture extending through said base sheet providing a recess within said base sheet, said aperture located to secure and position film in its perimeter and within said recess; said method comprising the steps of;

1) exposing an adhesive adjacent the perimeter of said aperture;

2) securing film to be processed in position over said aperture, within said recess and against said adhesive and 3) feeding said film carrier transport adaptor and film through a film processor.

* * * * *